US006012025A

United States Patent [19]

Yin

[11] Patent Number: 6,012,025

[45] Date of Patent: Jan. 4, 2000

[54] AUDIO CODING METHOD AND APPARATUS USING BACKWARD ADAPTIVE PREDICTION

[75] Inventor: Lin Yin, Miltapas, Calif.

[73] Assignee: Nokia Mobile Phones Limited, Espoo, Finland

[21] Appl. No.: 09/014,712

[22] Filed: Jan. 28, 1998

[51] Int. Cl.[7] ..... G10L 9/14

[52] U.S. Cl. ..... 704/219; 704/229; 704/205; 704/211; 704/230; 704/223

[58] Field of Search ..... 704/206, 204, 704/219, 229, 220, 205, 211, 222, 224, 230

[56] References Cited

U.S. PATENT DOCUMENTS

| | | | |
|---|---|---|---|
| 4,184,049 | 1/1980 | Crochiere et al. | 704/209 |
| 4,847,905 | 7/1989 | Lefevre et al. | 704/219 |
| 5,084,904 | 1/1992 | Daito | 375/27 |
| 5,206,884 | 4/1993 | Bhaskar | 375/34 |
| 5,369,724 | 11/1994 | Lim | 704/206 |
| 5,473,727 | 12/1995 | Nishiguchi et al. | 395/2.31 |
| 5,557,639 | 9/1996 | Heikkila et al. | 375/224 |
| 5,596,677 | 1/1997 | Jarvinen et al. | 395/2.29 |
| 5,600,753 | 2/1997 | Iso | 704/200 |
| 5,617,507 | 4/1997 | Lee et al. | 704/200 |
| 5,657,350 | 8/1997 | Hofmann | 375/241 |
| 5,699,484 | 12/1997 | Davis | 704/219 |
| 5,736,943 | 4/1998 | Herre et al. | 341/50 |
| 5,794,185 | 8/1998 | Bergstrom et al. | 704/223 |
| 5,809,459 | 9/1998 | Bergstrom et al. | 704/223 |

FOREIGN PATENT DOCUMENTS

| | | |
|---|---|---|
| 0 673 014 A2 | 9/1995 | European Pat. Off. . |
| 0 692 881 A1 | 1/1996 | European Pat. Off. . |
| 2 318 029 | 4/1998 | United Kingdom . |

OTHER PUBLICATIONS

Grill et al., ("Coding of Moving pictures and associated Audio", ISO/IEC/JTC1/SC@(/WG11, MPEG95/0426, Oct. 26, 1995).

Written Opinion from the European Patent Office.

Fuchs et al. "Improving MPEG Audio Coding by Backward Adaptive Linear Stereo Prediction" AES Convention, New York, Preprint 4086 Oct. 1995.

PCT International Search Report.

United Kingdom Search Report.

*Primary Examiner*—David R. Hudspeth
*Assistant Examiner*—Vijay B Chawan
*Attorney, Agent, or Firm*—Perman & Green, LLP

[57] ABSTRACT

A method of coding an audio electrical signal using backward adaptive prediction. A first time frame of the audio electrical signal to be coded is received and transformed into the frequency domain using a modified discrete cosine transform (MDCT). The resulting frequency spectrum has 1024 spectral components. Subsequent time frames of the audio electrical signal are then received and the MDCT is applied to each in turn so as to generate a stream of spectral data values for each spectral component. For each stream, a set of prediction coefficients is calculated for each spectral value using a predetermined number of previously received consecutive spectral values of the stream. Using the set of linear prediction coefficients, a predicted spectral value is generated and the error between the predicted spectral value and the corresponding actual spectral value calculated. The calculated errors provide a coded representation of the spectral value stream.

14 Claims, 1 Drawing Sheet

AUDIO CODING METHOD AND APPARATUS USING BACKWARD ADAPTIVE PREDICTION

FIELD OF THE INVENTION

The present invention relates to a method for coding and decoding electronic signals and to apparatus for carrying out such a method.

BACKGROUND OF THE INVENTION

It is well known that the transmission of data in digital form provides for increased signal to noise ratios and increased information capacity along the transmission channel. There is however a continuing desire to further increase channel capacity by compressing digital signals to an ever greater extent. In relation to audio signals, two basic compression principles are conventionally applied. The first of these involves removing the statistical or deterministic redundancies in the source signal whilst the second involves suppressing or eliminating from the source signal elements which are redundant in so far as human perception is concerned. Recently, the latter principle has become predominant in high quality audio applications and typically involves the separation of an audio signal into frequency components (sometimes called 'sub-bands'), each of which is analysed and quantized with a quantisation accuracy determined to remove data irrelevancy (to the listener). The ISO (International Standards Organisation) MPEG (Moving Pictures Expert Group) audio coding standard and other audio coding standards employ and further define this principle. However, MPEG (and other standards) also employs a technique known as 'adaptive prediction' to produce a further reduction in data rate.

A particular form of adaptive prediction is known as 'backward adaptive lattice prediction'. Fuchs et al, 'Improving MPEG Audio Coding by Backward Adaptive Linear Stereo Prediction', AES Convention, New York, Preprint 4086 October 1995, describes one such backward adaptive lattice prediction algorithm. For each spectral value (the 'current' value) of each frequency component, backward adaptive lattice prediction generates a set of prediction coefficients in the coder from the previously calculated spectral values of that component (via the intermediate calculation of quantized spectral values). These coefficients are then used to predict the value of the current spectral value. The error between the current spectral value and the predicted spectral value is determined and it is this error value (after quantisation) which is transmitted to the receiver. It will be appreciated that at any given time, the current prediction coefficients have effectively been derived from all previously received sample values. At the receiver, the coefficients are similarly calculated and reconstructed spectral values obtained by combining the predicted spectral values with the received error values.

In certain algorithms employing backward adaptive prediction, it is often the case that a measure of the compression achieved is determined during the compression process and the error values sent only if positive compression gain is achieved. If not, then the actual quantized frequency component signals are transmitted instead.

The new MPEG-2 AAC standard employs psychoacoustic modeling and backward adaptive linear prediction with 1024 frequency components. It is envisaged that the new MPEG-4 VM standard will have similar requirements. However, such a large number of frequency components results in a large computational overhead due to the complexity of the prediction algorithm and also requires the availability of large areas of memory to store the calculated coefficients. Additionally, with backward adaptive lattice prediction, even when the predictors are turned 'off' (e.g. when no compression advantage can be obtained by transmitting the error values), the decoder must continue to determine the coefficients so that the predictors can be turned 'on' again when required without any temporary degradation in performance. This provides an additional computation overhead.

It is an object of the present invention to overcome or at least mitigate one or more of the above disadvantages.

This object is achieved by utilising a backward adaptive prediction algorithm which acts upon a relatively large number of frequency components of an audio signal to be coded and which calculates prediction coefficients for a component from a predetermined number of previously received sample values of that component.

SUMMARY OF THE INVENTION

According to a first aspect of the present invention there is provided a method of coding an audio electrical signal using backward adaptive prediction, the method comprising the steps of:

(a) receiving a first time frame of an audio electrical signal to be coded;

(b) transforming the time frame into the frequency domain to generate a frequency spectrum having 512 or more spectral components;

(c) receiving subsequent time frames of said audio electrical signal and repeating step (b) for these frames in sequence to generate a stream of spectral data values for each spectral component;

(e) for each said stream, calculating a set of prediction coefficients for each spectral value using the covariances of a predetermined number of previously determined reconstructed spectral values of the stream, using said set of prediction coefficients to generate a predicted spectral value, and calculating the error between the predicted spectral value and the corresponding actual spectral value, wherein the calculated errors provide a coded representation of the spectral value stream and said errors can be recombined with predicted spectral values to obtain reconstructed spectral values.

The method of the present invention does not directly calculate a set of prediction coefficients from all preceding spectral components as is the case with conventional backward adaptive prediction algorithms. That is to say that the prediction coefficients are recalculated for each spectral value and are not merely adapted from the previously calculated set. Thus, during periods when the predictor is turned off, there is no requirement to continue updating the coefficients at the decoder.

It has been discovered that, whilst backward adaptive prediction algorithms which calculate prediction coefficients from the covariances of a predetermined number of previous spectral values are generally not suitable for coding audio signals sub-divided into a relatively small number of frequency sub-bands (e.g. 32), such prediction algorithms are appropriate when the audio signal is sub-divided into a relatively large number of frequency sub-bands (e.g. 1024 as defined in the draft MPEG-4 standard). This is because, when a large number of sub-bands are defined, the order of the prediction algorithm (that is the number of prediction coefficients) can be low and algorithms embodying the present invention offer high performance and are computationally efficient for low orders. Preferably, the prediction order is one or two. More preferably, the prediction order is two.

Preferably, said predetermined number of previously received consecutive spectral values are used to derive a corresponding number of quantized spectral values. It is then the quantized values which are used to calculate said prediction coefficients.

Preferably, the time windows taken from the audio signal are overlapping. For example, each window may contain 2048 sample points with adjacent window having a 50% overlap. However, the windows may also be contiguous.

In certain embodiments of the invention, a new set of prediction coefficients may be calculated for each and every spectral value. However, in other embodiments it may be more computationally efficient to recalculate the prediction coefficients for only every second or third (or other multiple) spectral value and to use the same coefficients for several consecutive spectral values. It may also be appropriate to provide for switching between a low coefficient update rate (e.g. every second value) and a high update rate (e.g. for every spectral value) immediately upon detection of a transient in the audio signal.

The lower limit on the predetermined number of previously received sample points used to calculate each set of prediction coefficients, is determined by the coding quality required. Preferably however, the number is four or more. The upper limit on this number is determined by memory and computational constraints. Preferably the number is ten or less. More preferably the predetermined number is six.

Any suitable method for evaluating the prediction coefficients may be used, e.g. an autocorrelation method. However, it has been found that the least squares method is particularly advantageous.

Preferably, the prediction coefficients used to calculate predicted spectral values are linear prediction coefficients.

It will be appreciated that the present invention is intended for use with psychoacoustic compensation and that quantisation of the error signals may be controlled accordingly.

According to a second aspect of the present invention there is provided a method of decoding an audio electrical signal encoded using the method of the above first aspect, the decoding method comprising the steps of:

receiving as an input signal a sequence of error values corresponding to the coded audio signal and separating these values into spectral component streams;

for each stream, determining a corresponding predicted spectral component value for each error value using a set of prediction coefficients, the prediction coefficients being calculated using covariances of a predetermined number of previously determined consecutive predicted spectral component values for that stream, and combining the error value and the predicted spectral value to provide a reconstructed spectral value; and substantially reconstructing said audio signal by combining and frequency-to-time transforming the reconstructed spectral values of all of the streams.

It will be appreciated that the specific implementation details of the coding method will to a large extent determine the implementation details of the decoding method, e.g. prediction order.

According to a third aspect of the present invention there is provided apparatus for coding an audio electrical signal using backward adaptive prediction, the apparatus comprising:

an input for receiving an audio electrical signal to be coded;

a time-to-frequency domain transformer for transforming sequentially received time frames of the received signal from the time domain to the frequency domain to provide frequency spectra having 512 or more spectral components;

signal processing means associated with each spectral component for receiving as a stream the associated spectral values, for calculating for each spectral value a set of prediction coefficients using covariances of a predetermined number of previously reconstructed spectral values, for using said set of prediction coefficients to generate a predicted spectral value, and for calculating the error between the predicted value and the corresponding actual spectral value, the calculated errors providing a coded representation of the received spectral value stream and wherein said errors can be recombined with predicted spectral values to obtain reconstructed spectral values.

According to a fourth aspect of the present invention there is provided apparatus for decoding an audio electrical signal encoded using the apparatus of the above third aspect of the present invention, the apparatus comprising:

an input for receiving a sequence of error values corresponding to the coded audio signal; and signal processing means for separating said sequence of values into separate spectral component streams and for determining for each error value a corresponding predicted spectral value a set of prediction coefficients, the signal processing means being arranged to calculate the prediction coefficients using covariances of a predetermined number of previously determined consecutive reconstructed spectral values, the signal processing means being further arranged to combine each error value with the corresponding predicted spectral value to provide a reconstructed spectral value and to substantially reconstruct said audio signal by combining and frequency-to-time transforming the reconstructed spectral values of all of the sub-bands.

According to a fifth aspect of the present invention there is provided a communications system comprising in combination the apparatus of the third and fourth aspect of the present invention.

According to a sixth aspect of the present invention there is provided a mobile communication device comprising apparatus according to the third and fourth aspect of the present invention.

DETAILED DESCRIPTION

Figure 1:
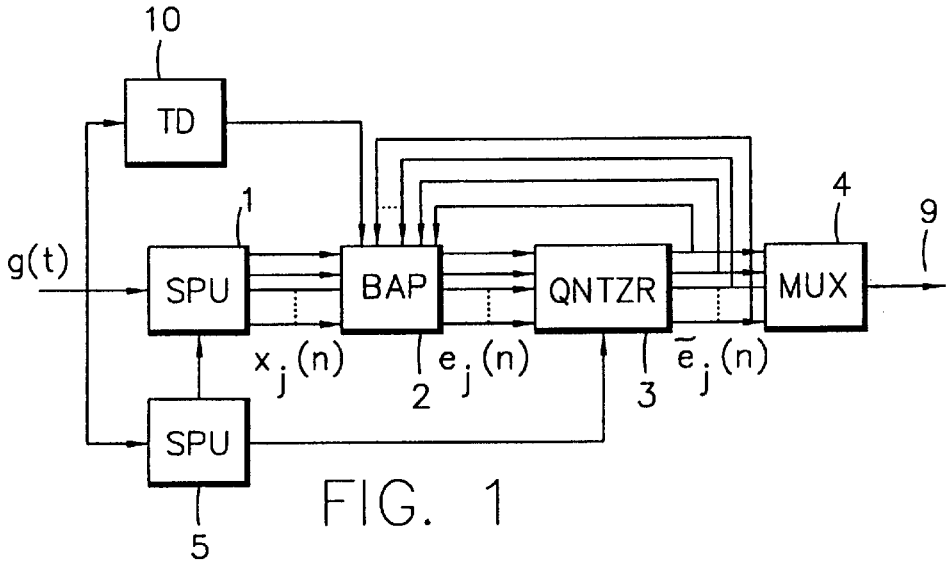
FIG. 1 shows schematically apparatus for coding an audio signal using backward adaptive prediction according to an embodiment of the present invention.

With reference to FIG. (SPU) 1, a pulse code modulated (PCM) audio input signal g(t) to be coded is provided at the input to a first signal processing unit 1 of a coding apparatus. This first unit 1 is arranged to transform the input signal g(t) from the time to the frequency domain on a frame by frame basis, each frame n consisting of 2048 sample values and adjacent frames having a 50% overlap. More particularly, the unit 1 employs a modified discrete cosine transform (MDCT) to transform the signal into the frequency domain such that the output of the unit 1 consists of 1024 separate streams of spectral values $x_j(n)$, each stream j corresponding to a different spectral component. It is noted that other transform methods may be used, e.g. a Fourier transform.

Each stream of data values $x_j(n)$ is provided to the corresponding input of a backward adaptive predictor (BAP) 2, the operation of which is described in detail below. In general terms, for each spectral value $x_j(n)$ of each stream, the predictor 2 calculates a set of prediction coefficients $a_j(n)$ using subsequently derived reconstructed quantized spectral values, in turn derived from previously received spectral values of that stream. The prediction coefficients are in turn used to calculate an error value $e_j(n)$ for the spectral value. The error values for each stream are provided to the input of a quantiser (QNTZR) 3 which is arranged to generate quantized errors $\tilde{e}_j(n)$ for subsequent digital transmission. The quantized errors $\tilde{e}_j(n)$ are provided to a multiplexer (MUX) 4, which generates a multiplexed error signal 9 for transmission, and are also fed back to the predictor 2.

A further signal processing unit (SPU) 5 is also provided for controlling the operation of the signal processing unit 1 and the quantiser 3 in dependence upon the psychoacoustic characteristics of the input audio signal g(t). The operation of this unit is conventional and will not be described in detail here.

For each spectral component j, x(n), $\hat{x}(n)$, and $\tilde{x}(n)$ are the input signal to the predictor 2, a predictor output signal, and a reconstructed quantized signal, and e(n) and $\tilde{e}(n)$ are a prediction error signal and a quantized prediction error signal. The set of prediction coefficients can be represented by:

$$a(n)=[a_1(n), a_2(n), \ldots, a_P(n)]^T$$

which is time dependent and where superscript T represents the Transpose. The output signal of the predictor 2 $\hat{x}(n)$ is calculated by:

$$\hat{x}(n) = a(n)^T \tilde{x}(n) = \sum_{i=1}^{P} a_i(n)\tilde{x}(n-i)$$

where $$\tilde{x}(n) = [\tilde{x}(n-1), \tilde{x}(n-2), \cdots, \tilde{x}(n-P)]^T$$

and P is the prediction order, i.e. the number of coefficients. The predictor error is $$e(n)=x(n)-\hat{x}(n)$$

and the reconstructed quantized signal is $$\tilde{x}(n)=\hat{x}(n)+\tilde{e}(n)$$

The calculation of the predictor coefficients is based on minimizing the mean square prediction error. a(n) can be expressed as $$a(n)=R^{-1}(n)r(n)$$

where $R(n)=E[\tilde{x}(n)\tilde{x}^T(n)]$ and $r(n)=E[\tilde{x}(n)\tilde{x}(n)]$ and the symbol E represents the Expectation.

It will be appreciated that once the autocorrelation functions r(n) are obtained, the linear predictors can be obtained by solving the normal equation. However, here a least squared algorithm is presented to estimate the linear predictor coefficients sample by sample. The least squared method often gives better linear prediction coefficient estimation than the autocorrelation method especially when the number of available data is small. It will be shown in the following that when the order of the predictor is low, in particular only two, the complexity of the least squared algorithm is comparable to or less than that of the adaptive lattice algorithm of the prior art.

Assume again that the reconstructed quantized signal is denoted by $\tilde{x}(n)$. For a prediction order of two and a block length of L, the covariances of the reconstructed signal are computed by $$r_{0,0} = \sum_{i=2}^{L-1} \tilde{x}^2(n-i),\ r_{1,1} = \sum_{i=2}^{L-1} \tilde{x}^2(n-i+1),$$

$$r_{0,1} = r_{1,0} = \sum_{i=2}^{L-1} \tilde{x}(n-i+1)\tilde{x}(n-i)$$

$$r_1 = \sum_{i=2}^{L-1} \tilde{x}(n-i+2)\tilde{x}(n-i),\ r_2 = \sum_{i=2}^{L-1} \tilde{x}(n-i+2)\tilde{x}(n-i+1)$$

An efficient algorithm would be $$temp_1 = \sum_{i=2}^{L-2} \tilde{x}^2(n-i),$$

$$r_{0,0} = \tilde{x}^2(n-L-1) + temp_1,\ r_{1,1} = temp_1 + \tilde{x}^2(n-1)$$

$$temp_2 = \sum_{i=2}^{L-2} \tilde{x}(n-i+1)\tilde{x}(n-i),$$

$$r_{0,1} = r_{1,0} = \tilde{x}(n-L+1)\tilde{x}(n-L+2) + temp_2$$

$$r_2 = temp_2 + \tilde{x}(n-1)\tilde{x}(n),\ r_1 = \sum_{i=2}^{L-1} \tilde{x}(n-i+2)\tilde{x}(n-i)$$

With these covariances, the two linear predictor coefficients can be calculated as follows:

$$a_1 = \frac{r_{1,1}r_1 - r_{0,1}r_2}{r_{0,0}r_{1,1} - r_{0,1}^2},$$

$$a_2 = \frac{r_{0,0}r_2 - r_{0,1}r_1}{r_{0,0}r_{1,1} - r_{0,1}^2},$$

It will be appreciated that the linear prediction coefficients are derived from a predetermined or fixed, relatively small, number of previous spectral values. Calculation of the coefficients is not dependent upon every previously received spectral value.

In order to enhance the robustness of the backward adaptive prediction against channel errors and numerical round-off errors, bandwidth expansion can be performed after the linear prediction coefficients are obtained. Let the linear prediction coefficients calculated by the above equations be $a_i$, i=0,1,2. where $a_0$=1. The bandwidth expansion operation replaces each $a_i$ by $\gamma^i a_i$, where $\gamma$ is a constant slightly less than unity.

As can be seen from the previous section, the covariance functions are updated sample by sample. Correspondingly, the linear prediction coefficients can also be obtained sample by sample by solving the normal equation. However, in order to save computation, the linear prediction coefficients can be calculated less frequently. For example, the linear prediction coefficients may be calculated once every two samples. The loss of the average prediction gain is negligible. However, the loss of the prediction gain is clearly noticeable upon occurrence of a transient in the audio signal to be coded. A transient detector (TD) 10 is therefore included which switches the predictor from a normal low coefficient update rate (e.g. every second spectral value) to a high update rate (e.g. every spectral value) when a transient is detected. The high update rate may be maintained for a short period after detection of the transient.

Assume that $G_l$ denotes the prediction gain in scalefactor band l. If $G_l>0$, the predictor in this subband can be switched on depending on the overall prediction gain, which is calculated as follows $$G = \sum_{l=1\&(G_1>0)}^{N_s} G_l$$

where $N_s$ is the number of scalefactor bands. If G compensates the additional bit need for the predictor side information, i.e., $G>_1$ (dB) or prediction gain does not drop dramatically, i.e., $G^{Present}-G^{Previous}<T_2$ (dB), the complete side information is transmitted and the predictors which produce positive gains are switched on: otherwise, the predictors are not used, which also means that the transient comes. After the transient frames are detected, the backward adaptive prediction coefficients are calculated sample by sample. After a certain number of samples, the prediction coefficients are calculated every second sample.

Figure 2:
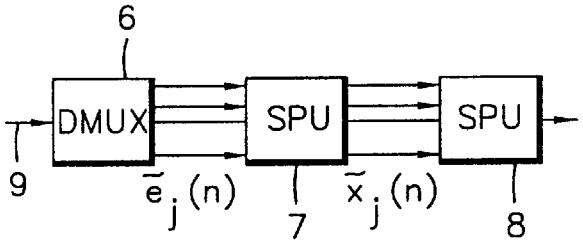
FIG. 2 shows schematically apparatus for decoding an audio signal encoded with the apparatus of FIG. 1.

FIG. 2 illustrates apparatus for decoding a signal encoded using the method described in detail above. The received multiplexed error signal 9 is provided at the input of a demultiplexer (DMUX) 6 which separates the signal into 1024 spectral value streams $e_l(n)$. These streams are then passed to a signal processing unit 7. For each stream, this unit (SPU) 7 calculates for each error value a predicted or estimated spectral value. A predetermined number of these predicted values are in turn used to calculate linear prediction coefficients to allow the calculation of a predicted value for a current sample. This process is identical to that described for the coding process. A reconstructed spectral value is obtained by combining the received error signal with the corresponding predicted value. The streams of reconstructed spectral values are provided to a further processing unit (SPU) 8 which carries out an inverse MDCT on the data to substantially regenerate the original audio signal.

Figure 3:
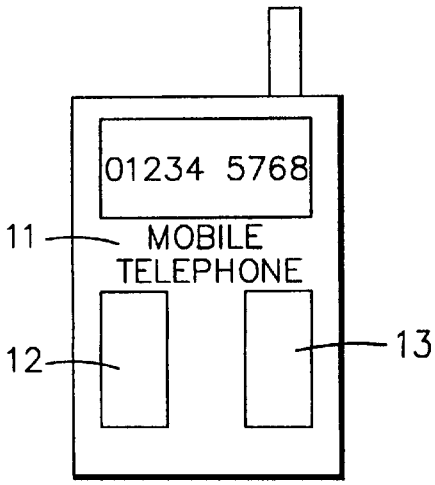
FIG. 3 shows a mobile telephone incorporating the apparatus of FIGS. 1 and 2.

FIG. 3 shows a mobile telephone 11 incorporating in its transmitter, apparatus 12 (corresponding to the apparatus of FIG. 1) for coding a radio telephone signal using the coding method described above. The telephone also incorporates in its receiver, apparatus 13 (corresponding to the apparatus of FIG. 2) for decoding a received encoded telephone signal.

I claim:

1. A method of coding an audio electrical signal using backward adaptive prediction, the method comprising the steps of:

(a) receiving a first time frame of an audio electrical signal to be coded;

(b) transforming the time frame into the frequency domain to generate a frequency spectrum having 512 or more spectral components;

(c) receiving subsequent time frames of said audio electrical signal and repeating step (b) for these frames in sequence to generate a stream of spectral data values for each spectral component;

(d) for each said stream, calculating a set of prediction coefficients for each spectral data value using the covariances of a predetermined number of previously determined reconstructed spectral values of the stream, using said set of prediction coefficients to generate a predicted spectral value, and calculating the error between the predicted spectral value and the corresponding actual spectral data value, and (e) constructing the calculated errors wherein the calculated errors provide a coded representation of a spectral data value stream and said errors can be recombined with predicted spectral values to obtain reconstructed spectral values for producing a coded audio signal.

2. A method according to claim 1, wherein the prediction order is two.

3. A method according to claim 1 and comprising recalculating the prediction coefficients only after receipt of multiple spectral values and using the same coefficients for several consecutive spectral values.

4. A method according to claim 3, wherein said multiple is two.

5. A method according to claim 3 and comprising switching between a low coefficient update rate and a high update rate immediately upon detection of a transient in the audio signal to be coded.

6. A method according to claim 1, wherein said predetermined number of spectral values is four or more.

7. A method according to claim 1, wherein said predetermined number of spectral values is ten or less.

8. A method according to claim 1, wherein a least squares method is used for evaluating the prediction coefficients.

9. A method according to claim 1, wherein said covariances are determined as:

$$r_{0,0} = \sum_{i=2}^{L-1} \tilde{x}^2(n-i),\ r_{1,1} = \sum_{i=2}^{L-1} \tilde{x}^2(n-i+1),$$

$$r_{0,1} = r_{1,0} = \sum_{i=2}^{L-1} \tilde{x}(n-i+1)\tilde{x}(n-i)$$

$$r_1 = \sum_{i=2}^{L-1} \tilde{x}(n-i+2)\tilde{x}(n-i),\ r_2 = \sum_{i=2}^{L-1} \tilde{x}(n-i+2)\tilde{x}(n-i+1)$$

$$temp_1 = \sum_{i=2}^{L-2} \tilde{x}^2(n-i),$$

$$r_{0,0} = \tilde{x}^2(n-L-1) + temp_1,\ r_{1,1} = temp_1 + \tilde{x}^2(n-1)$$

$$temp_2 = \sum_{i=2}^{L-2} \tilde{x}(n-i+1)\tilde{x}(n-i),$$

$$r_{0,1} = r_{1,0} = \tilde{x}(n-L+1)\tilde{x}(n-L+2) + temp_2$$

$$r_2 = temp_2 + \tilde{x}(n-1)\tilde{x}(n),\ r_1 = \sum_{i=2}^{L-1} \tilde{x}(n-i+2)\tilde{x}(n-i).$$

10. A method according to claim 9, wherein the prediction coefficients are determined according to:

$$a_1 = \frac{r_{1,1}r_1 - r_{0,1}r_2}{r_{0,0}r_{1,1} - r_{0,1}^2},$$

-continued $$a_2 = \frac{r_{0,0}r_2 - r_{0,1}r_1}{r_{0,0}r_{1,1} - r_{0,1}^2},$$

11. A method of decoding a coded audio electrical signal, the decoding method comprising the steps of:

receiving as an input signal a sequence of error values corresponding to the coded audio signal and separating these error values into spectral component streams;

for each component stream, determining a corresponding predicted spectral component value for each error value using a set of prediction coefficients, the prediction coefficients being calculated using covariances of a predetermined number of previously determined consecutive predicted spectral component values for that stream, and combining the error value and the predicted spectral value to provide a reconstructed spectral value; and substantially reconstructing said audio signal by combining and frequency-to-time transforming the reconstructed spectral values of all of the component streams.

12. Apparatus for coding an audio electrical signal using backward adaptive prediction, the apparatus comprising:

an input for receiving an audio electrical signal to be coded;

a time-to-frequency domain transformer for transforming sequentially received time frames of the received audio signal from the time domain to the frequency domain to provide frequency spectra having 512 or more spectral components;

signal processing means associated with each spectral component for receiving as a stream the associated spectral values, for calculating for each spectral value a set of prediction coefficients using covariances of a predetermined number of previously reconstructed spectral values, for using said set of prediction coefficients to generate a predicted spectral value, and for calculating the error between the predicted value and the corresponding actual spectral value, the calculated errors providing a coded representation of the received spectral value stream and wherein said error can be recombined with predicted spectral values to obtain reconstructed spectral values for producing a coded audio signal.

13. Apparatus for decoding a coded audio electrical signal, the apparatus comprising:

an input for receiving a sequence of error values corresponding to the coded audio signal; and signal processing means for separating said sequence of error values into separate spectral component streams and for determining for each error value a corresponding predicted spectral value using a set of prediction coefficients, the signal processing means being arranged to calculate the prediction coefficients, using covariances of a predetermined number of previously determined consecutive reconstructed spectral values, the signal processing means being further arranged to combine each error value with the corresponding predicted spectral value to provide a reconstructed spectral value and to substantially reconstruct said audio signal by combining and frequency-to-time transforming the reconstructed spectral values of all of the streams.

14. A mobile communications device comprising:

coding apparatus for coding an audio electrical signal using backward adaptive prediction, comprising:

an input for receiving an audio electrical signal to be coded;

a time-to-frequency domain transformer for transforming sequentially received time frames of the received audio signal from the time domain to the frequency domain to provide frequency spectra having 512 or more spectral components;

signal processing means associated with each spectral component for receiving as a stream the associated spectral values, for calculating for each spectral value a set of prediction coefficients using covariances of a predetermined number of previously reconstructed spectral values, for using said set of prediction coefficients to generate a predicted spectral value, and for calculating the error between the predicted value and the corresponding actual spectral value, the calculated errors providing a coded representation of the received spectral value stream and wherein said errors can be recombined with predicted spectral values to obtain reconstructed spectral values; and decoding apparatus for decoding a coded audio electrical signal, comprising:

an input for receiving a sequence of error values corresponding to the coded audio signal; and signal processing means for separating said sequence of values into separate spectral component streams and for determining for each error value a corresponding predicted spectral value using a set of prediction coefficients, the signal processing means being arranged to calculate the prediction coefficients, using covariances of a predetermined number of previously determined consecutive reconstructed spectral values, the signal processing means being further arranged to combine each error value with the corresponding predicted spectral value to provide a reconstructed spectral value and to substantially reconstruct said audio signal by combining and frequency-to-time transforming the reconstructed spectral values of all of the streams.

* * * * *